US010544651B2

(12) United States Patent
Burwell et al.

(10) Patent No.: US 10,544,651 B2
(45) Date of Patent: Jan. 28, 2020

(54) PRESSURE BALANCED SETTING TOOL

(71) Applicant: Schlumberger Technology Corporation, Sugar Land, TX (US)

(72) Inventors: Bryan Burwell, Angleton, TX (US); Stephen Walter Jeske, Sugar Land, TX (US); Erika R. Cerda, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 350 days.

(21) Appl. No.: 15/312,842

(22) PCT Filed: Apr. 30, 2015

(86) PCT No.: PCT/US2015/028568
§ 371 (c)(1),
(2) Date: Nov. 21, 2016

(87) PCT Pub. No.: WO2015/179100
PCT Pub. Date: Nov. 26, 2015

(65) Prior Publication Data

US 2017/0191347 A1 Jul. 6, 2017

Related U.S. Application Data

(60) Provisional application No. 62/001,431, filed on May 21, 2014, provisional application No. 62/001,441,
(Continued)

(51) Int. Cl.
*E21B 34/06* (2006.01)
*E21B 23/04* (2006.01)
(Continued)

(52) U.S. Cl.
CPC ..... *E21B 34/063* (2013.01); *E21B 23/04* (2013.01); *E21B 23/06* (2013.01); *E21B 33/128* (2013.01);
(Continued)

(58) Field of Classification Search
CPC ..... E21B 34/10; E21B 34/102; E21B 34/103; E21B 34/14; E21B 2034/007; E21B 33/12; E21B 33/128; E21B 33/1295
See application file for complete search history.

(56) References Cited

U.S. PATENT DOCUMENTS 4,665,992 A 5/1987 Franc
5,893,413 A 4/1999 Lembcke et al.
(Continued)

OTHER PUBLICATIONS

PCT/US2015/028568 International Search Report and Written Opinion, dated Jul. 30, 2015, 13 pgs.

*Primary Examiner* — Kristyn A Hall
*Assistant Examiner* — Tara E Schimpf

(57) ABSTRACT

A system including a downhole device coupled to a pressure balanced setting tool. The setting tool may be pressure balanced to lock a setting piston in place as the system is deployed into a well. That is, in spite of downhole well pressures, no substantial differential may emerge between the setting piston and the annular space of the well adjacent the system. Thus, the setting piston may remain locked in place until triggered for setting. This may include breaching a rupture disc of another piston to disrupt hydraulic communication between the setting piston and the annular space. This allows subsequent triggering, for example through another breach of a rupture disc defining a volumetric chamber, to take place in a manner that allows stroking of the setting piston. In this way, the setting tool may be utilized to achieve setting of the downhole device.

16 Claims, 5 Drawing Sheets

Related U.S. Application Data filed on May 21, 2014, provisional application No. 62/001,451, filed on May 21, 2014.

(51) Int. Cl.

| | |
|---|---|
| ***E21B 33/128*** | (2006.01) |
| ***E21B 34/10*** | (2006.01) |
| ***E21B 34/14*** | (2006.01) |
| ***E21B 23/06*** | (2006.01) |
| ***E21B 33/1295*** | (2006.01) |
| ***E21B 34/00*** | (2006.01) |

(52) U.S. Cl.

CPC ..... *E21B 33/1295* (2013.01); *E21B 34/00* (2013.01); *E21B 34/10* (2013.01); *E21B 34/102* (2013.01); *E21B 34/103* (2013.01); *E21B 34/14* (2013.01); *E21B 2034/007* (2013.01)

(56) References Cited

U.S. PATENT DOCUMENTS

| | | | | |
|---|---|---|---|---|
| 7,231,987 | B2 | 6/2007 | Kilgore et al. | |
| 7,284,619 | B2 * | 10/2007 | Stokley | E21B 33/146 166/387 |
| 7,562,712 | B2 | 7/2009 | Cho et al. | |
| 7,836,961 | B2 | 11/2010 | Li et al. | |
| 9,447,649 | B2 * | 9/2016 | Doane | E21B 33/1272 |
| 2007/0012460 | A1 | 1/2007 | Coronado | |
| 2009/0242199 | A1 | 10/2009 | Basmajian et al. | |
| 2009/0321081 | A1 | 12/2009 | Schramm et al. | |
| 2013/0220638 | A1 | 8/2013 | Greenlee et al. | |
| 2013/0233570 | A1 | 9/2013 | Acosta et al. | |
| 2013/0292137 | A1 | 11/2013 | Lauderdale | |
| 2015/0041148 | A1 * | 2/2015 | Greenan | E21B 34/102 166/374 |

* cited by examiner

PRESSURE BALANCED SETTING TOOL

PRIORITY CLAIM/CROSS REFERENCE TO RELATED APPLICATION(S)

This Patent Document claims priority under 35 U.S.C. § 119 to U.S. Provisional App. Ser. Nos. 62/001,431, 62/001,441, and 62/001,451, each filed on May 21, 2014 and incorporated herein by reference in their entireties.

BACKGROUND

Exploring, drilling and completing hydrocarbon and other wells are generally complicated, time consuming, and ultimately very expensive endeavors. As a result, over the years, a significant amount of added emphasis has been placed on overall well architecture, monitoring and follow-on interventional maintenance. Careful attention to the cost effective and reliable execution of completing such wells and carrying out such applications may help maximize production and extend well life. Thus, a substantial return on the investment in the completed well may be better ensured.

In line with the objectives of maximizing cost effectiveness and overall production, the well may be fairly sophisticated in terms of architecture. For example, the well may be tens of thousands of feet deep, traversing various formation layers, and zonally isolated throughout. That is to say, packers may be intermittently disposed about tubing such as production tubing which runs through the well so as to isolate various well regions or zones from one another. Thus, production may be extracted from certain zones through the production tubing, but not others. Indeed, the particular zones from which production is sought may change over the life of the well as the production profile changes. Additionally, production tubing may ultimately terminate adjacent a production region where it is generally anchored or immobilized in place thereat by a mechanical packer, irrespective of any other zonal isolation thereabove.

In the majority of circumstances, the packers utilized to achieve the zonal or terminal isolations noted are mechanical packers that may be "set" in a variety of different manners. That is, as opposed to swell packers that are made up of a swellable elastomer which achieves an isolating seal over a period of time, mechanical packers are deployed to a target location and then driven to expand and seal at the location. The triggering of this setting is generally achieved with a setting tool which includes a hydraulic piston in communication with compressible features of the packer. Specifically, a stroking of the piston may be used to forcibly actuate the packer into setting engagement with a casing defining the well wall. This may include teeth or slips of the packer as well as seal members engaging the wall for sake of anchoring and sealing at the location.

Different techniques may be utilized which allow an operator at the surface of the oilfield to trigger the setting tool for sake of stroking the piston and setting the packer as noted above. For example, a hydraulic or electric line may run from power equipment at the oilfield surface adjacent the well to allow the operator to trigger the setting action. Unfortunately, this requires the addition of the line running potentially several thousand feet through the well in order to reach the setting tool. Setting aside the added cost of the line, this also means that packer setting is dependent upon potentially several thousands of feet of line remaining reliably unharmed during deployment and exposure to the downhole environment.

In order to avoid the added expense and potential failure of a line running to a setting tool, the setting tool may be triggered without use of a line. Instead, the operator may make use of fluid pressure in the well to direct the setting tool to initiate setting of the packer at the appropriate time. For example, once the tubing which accommodates the packer is fully installed, a plug may be run through the interior of the tubing and to a location below the packer and setting tool. From the oilfield surface, the operator may then drive up pressure within the tubing to create a predetermined pressure differential between the tubing interior and the annular pressure between the tubing and the well wall. The piston of the setting tool may ultimately be in fluid communication with both the annular space and the interior of the tubing such that once a predetermined differential is reached, the piston may stroke for setting of the packer.

Unfortunately, triggering the setting tool to set the packer by way of pressurizing the interior of the tubing presents another set of potential issues. For example, a plug must be deployed through the interior of the tubing before pressurizing may begin. Indeed, following packer setting, the plug will also be removed so that access to tubing locations further below the packer may be available. This means that a substantial amount of time may be required in added interventional trips for sake of plug installation and retrieval. Once more, the plug, tubing, valves within the tubing and a host of other devices therein may all be of limited pressure tolerances, perhaps under about 5,000 PSI. Thus, in circumstances where the annular pressure outside of the tubing is over 5,000 PSI, the operator would be forced to exceed these tolerances in order to create a sufficient differential for actuating the setting mechanism. In other words, the act of triggering the setting mechanism would be likely to damage the plug, tubing or other internal devices. Indeed, this is increasingly common as wells become deeper and deeper, often displaying annular pressures in excess of 5,000-10,000 PSI or more.

As an alternative to using a differential setting technique as described above, setting tools are available that do not rely on differential pressure for triggering. For example, a hydrostatic set module may rely on pressure supplied solely by the annular space. However, such tools are generally reliable where the annular pressure is below about 10,000 PSI. Thus, as a practical matter, as wells are increasingly of greater depths and pressures, the setting tool often remains tethered to surface equipment for sake of actuation, unable to take advantage of less cumbersome pressure actuating techniques.

SUMMARY

A downhole setting tool is provided for use in a well. The tool includes a setting piston that defines a setting chamber and is configured to stroke for actuating a downhole device. A pressure activated piston is provided which governs communication through a channel that leads to both the setting chamber at one end and the well at the other. Specifically, open communication locks the setting piston and closed communication activates the setting piston. An isolation device is also coupled to the pressure activated piston and exposed to the well. The isolation device is of a predetermined pressure or burst rating such that an intention breach thereof via the well may be used to close the communication and activate the setting piston for the stroking.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments herein are described with reference to certain downhole isolating system applications. For example, embodiments depicted herein are of a packer being set downhole as part of a production assembly. However, a variety of alternate applications may take advantage of embodiments of pressure balanced setting tools as detailed herein. These may include applications utilizing packers for purposes other than production and even setting devices other than packers such as sliding sleeves, valves or any other number of downhole features. Regardless, so long as a setting piston of the system may be locked during deployment and unlocked for setting thereafter, appreciable benefit may be realized.

Figure 1:
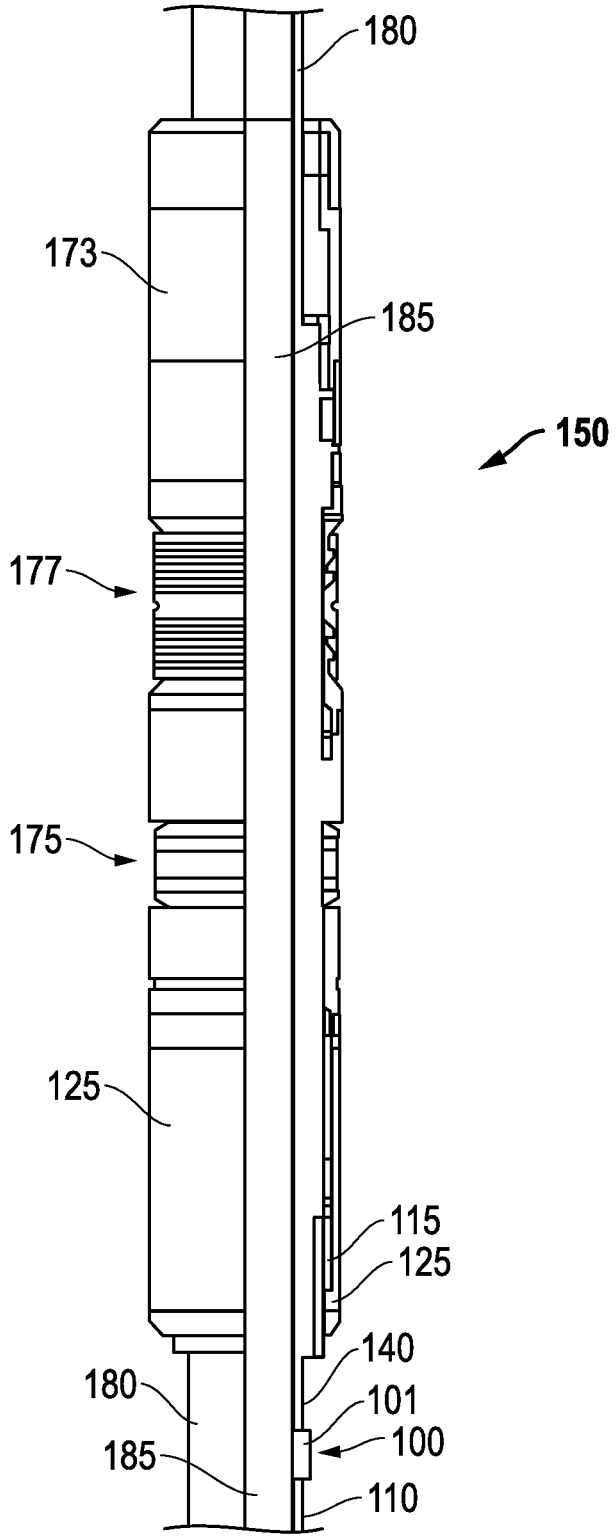
FIG. 1 is a front partially sectional view of an isolation system that incorporates an embodiment of a pressure balanced setting tool used for setting a packer.

Referring now to FIG. 1, a downhole isolation system is shown that includes a packer 150 secured to production tubing 180. The system also incorporates an embodiment of a pressure balanced setting tool 100 in order to set the packer 150. More specifically, once the system is deployed into a well, the packer 150 may be set to anchor and seal at a location of the well such that production fluids may be taken up by the production tubing 180 from below the packer 150. In terms of the noted anchoring, in the embodiment shown, the packer 150 is equipped with slips 177 that are configured for radial expansion during the setting process. This results in a biting engagement with a wall of the well in order to anchor the packer in place. Similarly, the packer 150 is equipped with an elastomeric seal element 175 that also radially expands during setting. In this case, the result is a fluidly sealed interface between the element 175 and well wall as contact is achieved between the two.

In the embodiment shown, in order to achieve the described setting of the packer 150, the pressure balanced setting tool 100 is utilized to direct the radial expansion of the slips 177 and the seal element 175. The setting tool 100 is mounted on the exterior of the system such that it is exposed to wellbore annular pressures. In the embodiment shown, the tool 100 is completely exposed. However, in other embodiments, the tool 100 may be more integral with the body of the system or outfitted with a protective sleeve to protect the tool 100 during system deployment into the well. Regardless, the setting tool 100 utilizes pressure differentials in order to effect stroking of a setting piston 125 for packer setting. However, the setting tool 100 is pressure balanced such that the piston 125 is locked during deployment of the system into a well while also substantially avoiding potential damage from excessive well pressures. Nevertheless, at the appropriate time after positioning, the tool 100 may be triggered from surface to provide for an imbalance or unlocking that ultimately allows setting to take place.

Continuing with reference to FIG. 1, the pressure balanced setting tool 100 works to set the packer 150 through the setting piston 125 as indicated. For example, in the embodiment shown, the setting piston 125 is moveable relative the underlying production tubular 180. However, other packer hardware 173 above the slips 177 and seal element 175 may be affixed to the tubular 180. Thus, during setting, the piston 125 may move upward, squeezing upon the slips 177 and element 175 such that the noted radial expansions thereof may be achieved.

In order to trigger the indicated upward movement of the setting piston 125, the pressure balanced setting tool 100 displays unique features. These features avoid the need for plugging the production channel 185 of the system or exposing its' entirety to excessive pressures for sake of an effective differential. Instead, as detailed further below, an isolation mechanism 101 is utilized that maintains a pressure balance between the well and a setting chamber 115 defined by the piston 125 (i.e. via a control line 140). In this way, the piston 125 is hydraulically locked in place. So, for example, in spite of potentially increasing or dramatically high pressures in the well during system deployment, the setting piston 125 may remain locked in place until setting is directed. Once more, the isolation mechanism 101 is also configured to allow for disruption of the pressure balance. That is, as detailed below, the hydraulic lock on the setting piston 125 may be controllably removed. This allows the pressure of the setting chamber 115 to be directed toward a volumetric chamber 110 thereby stroking the piston 125 upward for setting of the packer 150 as indicated.

Figure 2:
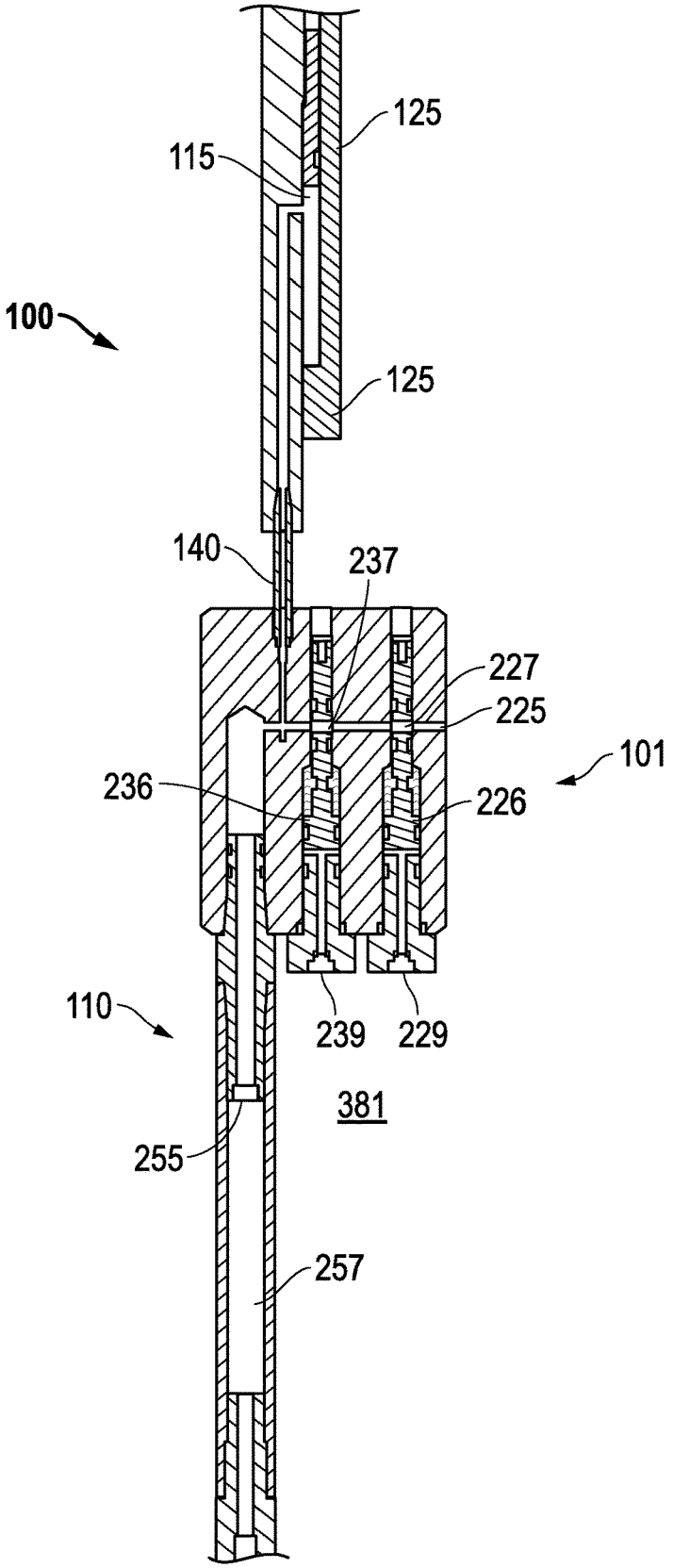
FIG. 2 is a cross-sectional view of the pressure balanced setting tool of FIG. 1 revealing the unique environment of a setting piston thereof.

Referring now to FIG. 2, a cross-sectional view of the pressure balanced setting tool 100 of FIG. 1 is shown revealing the unique relationship between the setting piston 125 and the isolation mechanism 101. As shown, the isolation mechanism 101 is exposed to the pressures of a well annulus 381. At the same time, however, the setting piston 125 defines a setting chamber 115 which, at the time of deployment from an oilfield surface, may be of comparatively lower or atmospheric pressure. The difference between this initial pressure of the setting chamber 115 and the pressure of the well annulus 381 may be quite dramatic. For example, in one embodiment, given ever increasing well depths and harsh environments, the well pressure may be upwards of 15,000 PSI. However, rather than allowing a tremendous differential to build during the deployment of the system into the well, the setting tool 100 maintains the safeguard of a pressure balance.

The noted pressure balance between the annulus 381 and the setting chamber 115 is afforded by a locking channel 225 which allows for fluid communication between the setting chamber 115 and the well annulus 381. Specifically, as shown, the channel 225 is open to the annulus 381 and in communication with the control line 140 which is in direct communication with the setting chamber 115. As a result, regardless of the initial pressure of the chamber 115, as the system is lowered into a well, it will balance to roughly take on an equivalent pressure to that of the annulus 381 (so long as the channel 225 is open as shown). That is, so long as the channel 225 is open, the setting piston 125 which defines the setting chamber 115 will be hydraulically locked.

Hydraulically locking the piston 125 as described above, allows for the system to be deployed deeper and deeper into the well without undue concern over the changing, and likely increasing pressures in the surrounding well annulus 381. That is, even though the annulus pressure may be dramatically increasing, no measurable differential results in the setting chamber 115. This is particularly noteworthy given that the setting piston 125 which defines the chamber 115 is nevertheless ultimately driven to stroke and set the adjacent packer 150 via differential pressure as described below.

Continuing with reference to FIG. 2, the isolation mechanism 101 is equipped with at least one isolation piston 226, 236. In the embodiment shown, multiple isolation pistons 226, 236 are shown for sake of redundancy. These isolation pistons 226, 236 each have the capability to block the flow-path of the locking channel 225. Specifically, as shown, a first piston 226 has the ability to block a first location 227 of the channel 225 whereas a second piston 236 has the ability to block a second location 237 of the channel 225. Regardless, if either of these locations 227, 237 are blocked, then so is the channel 225. Of course, when the channel 225 is blocked, then communication between the annulus 381 and the setting chamber 115 is cut off. As a result, the above described pressure balance between the annulus 381 and the chamber 115 is also terminated. Thus, as described below, the absence of the pressure balance allows for the introduction of a pressure differential that may be used to stroke the setting piston 125 and ultimately set the packer 150 of FIG. 1.

As indicated above, introducing a pressure differential for sake of actuating the setting piston 125 is preceded by at least one of the isolation pistons 226, 236 shifting into a position that blocks a corresponding location 227, 237 of the locking channel 225. Shifting the isolation pistons 226, 236 in this manner may be achieved through pressure actuation via the annulus 381. For example, each of the depicted isolation pistons 226, 236 is separated from the annulus 381 by a corresponding isolation rupture disc 229, 239 which may be of a pre-determined burst rating. Of course, other pressure dependent barrier devices may alternatively be utilized. Regardless, as noted above, the location of the depicted annulus 381 may be in a high pressure well that reaches about 15,000 PSI. With this in mind, rupture discs 229, 239 may be utilized that are configured to rupture at a pressure that is between about 500 and 1,500 PSI greater than the annular pressure. More specifically, in the described embodiment, the rupture discs 229, 239 may be rated to about 16,000 PSI (i.e. substantially above the known well pressure of 15,000 PSI).

In the embodiment shown, pressure at the non-annular side of the rupture discs 229, 239 is negligible or atmospheric. That is, there is no substantially pressurized space between the rupture discs 229, 239 and the isolation pistons 226, 236. Thus, once the annulus 381 reaches 16,000 PSI in the example described above, these discs 229, 239 are set to burst. Driving up the pressure in the annular space 381 in this manner may be intentionally directed from an oilfield surface by an operator so as to prepare the system for packer setting as describe herein. Bursting of the discs 229, 239 in this manner allows the pistons 226, 236 to shift into a position that blocks one of the locations 227, 237 of the locking channel 225. As indicated above, this ultimately removes the hydraulic lock on the setting piston 125 and may allow a setting application to proceed as discussed further below.

As a practical matter, bursting of the discs 229, 239 as described above may not take place simultaneously. For example, manufacturing tolerances may be such that one disc 229 is prone to burst at 15,900 PSI whereas the other 239 is more likely to burst at 16,100 PSI. Thus, utilizing redundant disc/piston configurations for the isolation mechanism 101 helps to ensure that the channel 225 is ultimately blocked. Of course, in other embodiments, more than two isolation pistons 226, 236 may be utilized or perhaps just one.

Continuing with reference to FIG. 2, once the locking channel 225 is blocked, the setting chamber 115 is now in terminal fluid communication with a piston 226 (or 236) but not the wellbore 381 at one end and a volumetric rupture disc 255 at the other. This disc 255 defines access to a volumetric chamber 257. In the exemplary embodiment described here, this chamber 257 may be set at atmospheric pressure. Although, in other embodiments, another substantially negligible pressure may be utilized. The volumetric chamber 257 is also of sufficient volume to allow for a sudden decrease in pressure of the setting chamber 115 once the volumetric rupture disc 255 is breached. Along these lines, the chamber 257 may be sized as appropriate depending on how much volume displacement is ultimately set to take place as potentially much higher pressure in the setting chamber 115 is emptied into the volumetric chamber 257 during setting piston 125 stroking as described below. Indeed, the scalability is such that tens of thousands of PSI may be emptied from the setting chamber 115 in the manner described herein. That is, the volumetric rupture disc 255 may be configured to burst just as with the isolation rupture discs 229, 239 as described above thereby resulting in an emptying or balancing out of pressure from the setting chamber 115.

Continuing with the example embodiment described above, the volumetric rupture disc 255 may be configured to rupture at a differential of about 17,000 PSI, that is, some level substantially safely above the ratings for the isolation rupture discs 229, 239. Thus, with the hydraulic lock on the setting piston 125 turned off, the operator may induce another thousand PSI of pressure into the annulus 381. Given that there is no hydraulic lock on the piston 125, the differential resulting between the annulus 381 and the volumetric chamber 257 may result in a breach of the rupture disc 255 which allows the setting piston 125 to stroke upwards. Thus, the packer 150 of FIG. 1 may be set to isolate a well as illustrated and discussed further below with reference to FIG. 3.

Figure 3:
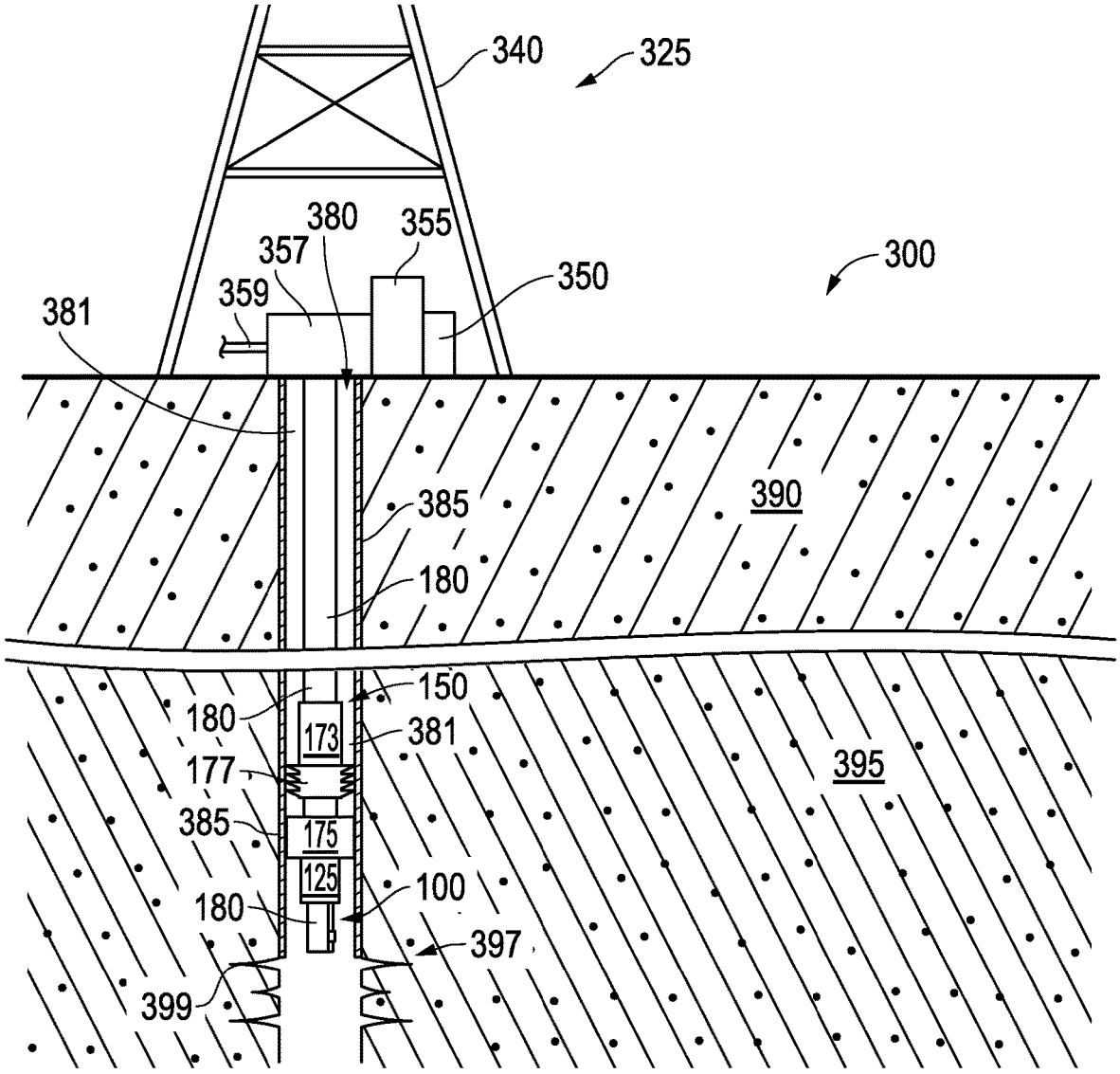
FIG. 3 is an overview schematic representation of an oilfield with a well accommodating the isolation system of FIG. 1 and setting tool embodiment thereof.

Referring now to FIG. 3, an overview schematic representation of an oilfield 300 is shown with a well 380 accommodating the isolation system of FIG. 1 therein. Specifically, the packer 150 of the system is shown set in the well 380 providing isolation. For example, the well 380 may include a production region 397 with perforations 399 extending into an adjacent formation 395. Thus, in order to target fluid uptake from the region 397 and through production tubing 180 of the system, isolation may be provided by the packer 150 just above the region 397.

As alluded to above, an embodiment of a pressure balanced setting tool 100 is employed to stroke the setting piston 125 in order to set the packer 150 as shown. The stroke of the setting piston 125 compressibly forces radial expansion of a seal element 175 and slips 177 of the packer 150. More specifically, the seal element 175 is forced into sealing engagement with the casing 385 which defines the well 380 whereas the slips 177 are forced into a biting anchored engagement with the casing 385.

In the embodiment shown, the well 380 may traverse various formation layers 390, 395 reaching several thousand feet in depth within a potentially harsh environment. Indeed, in the example described above, the annular space 381 around the system may be at about 15,000 PSI. Nevertheless, instead of having to manage all of the potential challenges of such a substantial differential throughout the deployment, the setting tool 100 is pressure balanced. Of course, even if annular pressures were only minimal, the deployment of the system and utilizing the setting tool 100 for packer setting would as described herein would remain effective.

Regardless, once positioned for setting, certain packer hardware 173 remains largely immobile and affixed to the production tubular 180 as the setting piston 125 strokes upward and compressibly sets the seal element 175 and slips 177 thereabove. With added reference to FIG. 2 and as indicated above, this may include increasing pressure in the annulus 381 to breach an isolating rupture disc (229 or 239) and break the hydraulic lock on the setting piston 125. An operator at the oilfield surface may then continue to drive up pressure sufficient to breach a volumetric rupture disc 255 which triggers actuation of the setting piston 125 (again, also see FIG. 2). Thus, production of fluids from the region 397 may be targeted. Of course, in other embodiments a variety of different downhole applications other than production may follow setting of a device with a pressure balanced setting tool 100 according to techniques detailed herein.

Continuing with reference to FIG. 3, in the embodiment shown, directing added pressure through the annulus 381 and managing production thereafter may be achieved through pumps 355 and a control unit 350 at the oilfield 300 adjacent the well head 357. A production line 359 is shown coupled to the well head 357 for carrying produced fluids away from the well 380 for further management. Additional surface equipment 325 is also shown such as a rig 340 to support the initial positioning of the system or any follow on interventional applications.

Figure 4C:
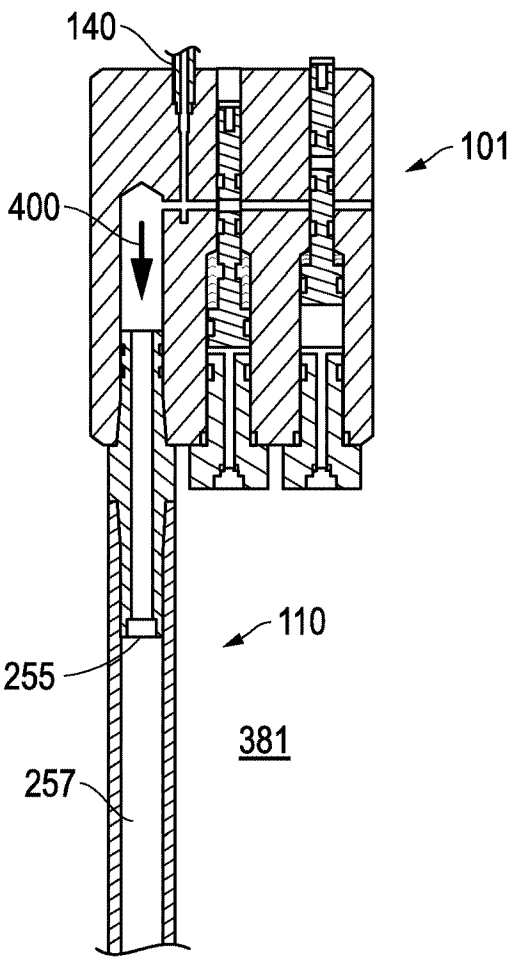
FIG. 4C is a side cross-sectional view of the setting tool of FIG. 4B with an isolation device thereof breached to allow stroking of the setting piston.
Figure 4B:
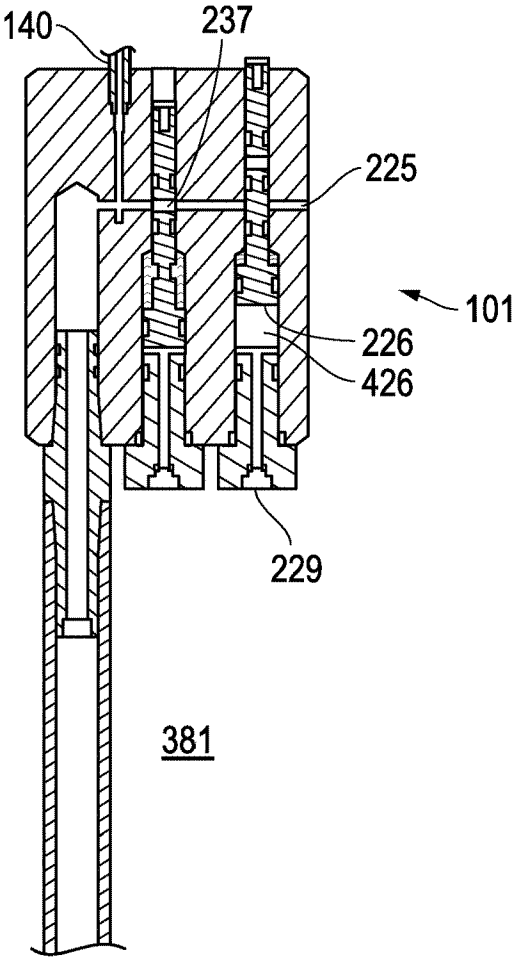
FIG. 4B is a side cross-sectional view of the setting tool of FIG. 4A with the pressure activated piston thereof in an unlocking position relative the setting piston.
Figure 4A:
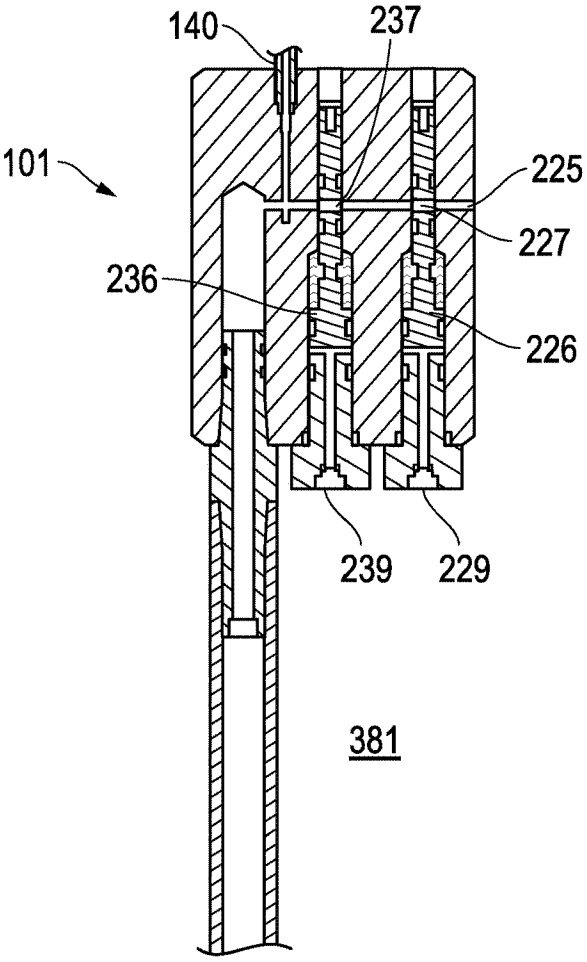
FIG. 4A is a side cross-sectional view of the setting tool of FIG. 2 with a pressure activated piston thereof in a locking position relative the setting piston.

Referring now to FIG. 4A, a side cross-sectional view of the setting tool isolation mechanism 101 is shown. More specifically, the pressure activated pistons 226, 236 of FIG. 2 are shown. In this enlarged view, the locking position of the pistons 226, 236 are readily evident. That is, the locking channel 225 is left open with both locations 227, 237 unobstructed by the pistons 226, 236. Thus, as indicated above, a pressure balance is maintained between the annulus 381 and the setting chamber 115 in communication with the control line 140 (see also FIGS. 1 and 2). As also indicated above, this balance is maintained so long as rupture discs 229, 239 remain intact. With reference to the example noted above, this balance of pressure may be at about 15,000 PSI.

Referring now to FIG. 4B is a side cross-sectional view of the isolation mechanism 101 of FIG. 4A is shown. In this depiction, one of the rupture discs 229 has been breached, for example, due to operator driven pressure increase in the annulus 381 up to about 16,000 PSI. Thus, the corresponding piston 226 has responsively shifted positions to block a location 227 (see FIG. 4A). That is, as indicated above, pressure in the annulus 381 may be increased to a level far enough above pressure in an isolation piston chamber 426 to allow for breach of the corresponding disc 229 and shifting of the piston 226 as depicted.

With added reference to FIGS. 1 and 2, blocking of the channel 225 in this manner shuts off the above described pressure balance. Specifically, as the pressure in the annulus 381 changes, there may be no corresponding pressure change in the control line 140 and setting chamber 115 given that there is no longer communication through the channel 225. As a result, continued driving up of pressure in the annulus 381 may result in a differential that leads to stroking of the setting piston 125. Stated another way, the setting piston 125 is no longer hydraulically locked and may be pressure activated for setting of the packer 150.

Continuing now with reference to FIG. 4C, with added reference to FIGS. 1-3, a side cross-sectional view of the isolation mechanism 101 of FIG. 4B is shown with the volumetric rupture disc 255 breached to allow stroking of the setting piston 125. Specifically, as described above, the pressure balance between the setting chamber 115 and the annulus 381 is now turned off Thus, an operator at a control unit 350 positioned at the oilfield surface 300 may wish to direct a pump 355 to further drive up pressure in the annulus 381, say to about 17,000 PSI in the noted example above. A differential relative the setting chamber 115 may now be created that allows some movement of the setting piston 125 which ultimately results in pressure being directed at the volumetric rupture disc 255 (see arrow 400). As indicated above, this may lead to breach of the disc 255 and emptying of pressurized fluid into the comparatively low pressure or atmospheric volumetric chamber 257.

The sudden emptying of the fluid into the chamber 257 as described above upon breach of the rupture disc 255 means that the setting chamber 115 will correspondingly and suddenly be able to reduce its volume. Thus, as this chamber 115 suddenly shrinks, the setting piston 125 strokes with force sufficient for setting the packer 150 as detailed hereinabove.

Figure 5:
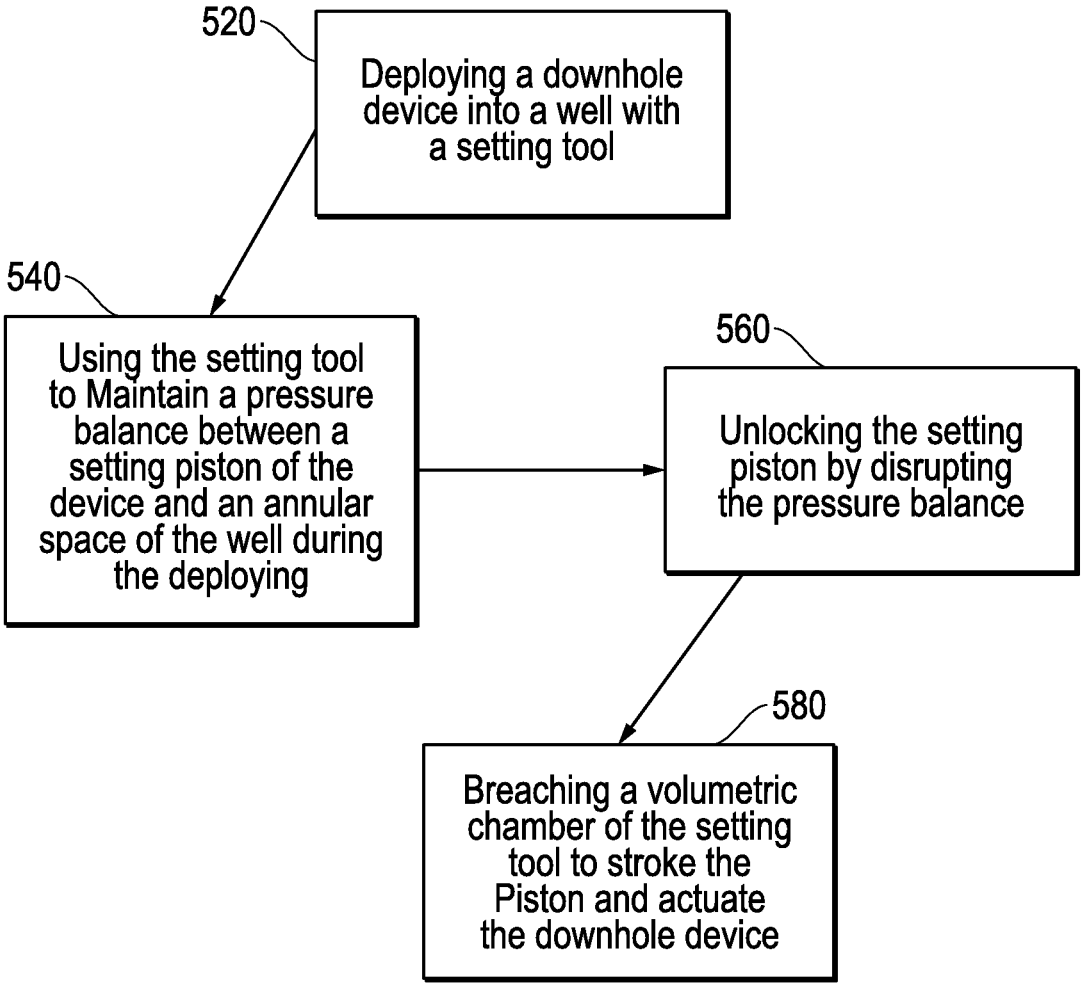
FIG. 5 is a flow-chart summarizing an embodiment of utilizing a pressure balanced setting tool for stroking a setting piston for actuating a downhole device.

Referring now to FIG. 5, a flow-chart summarizing an embodiment of utilizing a pressure balanced setting tool for stroking a setting piston and actuating a downhole device is shown. Simply put, the downhole device and setting tool are deployed into a well as indicated at 520 with a pressure balance being maintained between a setting piston of the assembly and the annular space of the well as indicated at 540. Once in place downhole, however, the setting piston may be unlocked or armed by disrupting the pressure balance as indicated at 560. In the embodiments described hereinabove, this is achieved by breaching a rupture disc to shift at least one isolating piston to a location that cuts off fluid communication between the annular space and the setting piston. Regardless, once this occurs, a volumetric chamber of the setting tool may be breached to allow a differential pressure in the tool to effectuate stroking of the piston as indicated at 580. For an embodiment of packer setting as described hereinabove, this may be followed by immobilizing the setting piston, for example with use of an expansion ring or other suitable locking device.

Embodiments described hereinabove include tools and techniques for setting a downhole device such as a packer without the requirement of dedicated line running to surface equipment at an oilfield surface. At the same time, these embodiments also allow for the avoidance of dedicated interventional trips into the well for sake of placing and receiving plugs to allow for an intervening pressurization application to set the device. Thus, not only is the expense of dedicated line hardware and management thereof avoided, but the added time and expense of running additional trips into the well for sake of effectively pressure setting the device is similarly avoided. In fact, pressure balanced setting tools and techniques detailed herein even allow for effective setting in substantially higher pressure environments as compared to conventional hydrostatic set modules or other tools that might avoid dedicated line hardware or trips for setting.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A system for positioning downhole in a well at an oilfield and exposing to an annulus of the well, the system comprising:

a downhole device for supporting an application in the well;

a setting piston coupled to the downhole device for stroking to actuate the device, the setting piston defining a setting chamber; and a pressure balanced setting tool with an isolation mechanism defining a channel for optional hydraulic communication between the setting chamber and the annulus to hydraulically lock the setting piston, wherein the isolation mechanism comprises:

an isolation piston; and an isolation pressure dependent barrier device in hydraulic alignment with the isolation piston and exposed to the annulus;

the pressure balanced setting tool further comprising:

a volumetric chamber in hydraulic communication with the setting chamber through a hydraulic control line; and a volumetric pressure dependent barrier device defining hydraulic access to the chamber.

2. The system of claim 1 wherein the downhole device is one of a packer, a sliding sleeve and a valve.

3. The system of claim 2 wherein the device is the packer set by the stroking of the setting piston and the application is production of downhole fluids through a production tubular running through the packer and to the oilfield.

4. The downhole setting tool of claim 1 wherein the volumetric and isolation pressure dependent barrier devices are rupture discs, the volumetric rupture disc having a burst rating substantially above a burst rating of the isolation burst disc.

5. The downhole setting tool of claim 4 wherein the volumetric rupture disc is breached via exposure to pressure above the burst rating therefor and the volumetric chamber is hydraulically exposed to the setting chamber.

6. The downhole setting tool of claim 5 wherein the volumetric chamber is sized to correspond with a potential pressure of the setting chamber at the time of the volumetric rupture disc breach.

7. The downhole setting tool of claim 6 wherein the volumetric chamber is sized to accommodate an influx of over 10,000 PSI from the setting chamber.

8. A pressure balancing downhole setting tool for deployment into a well and exposing to an annulus thereof, the tool comprising:

a hydraulic control line coupled to a setting chamber defined by a setting piston, the setting piston for stroking to actuate a downhole device coupled thereto; and an isolation mechanism defining a channel for optional hydraulic communication between the setting chamber and the annulus to hydraulically lock the setting piston, wherein the isolation mechanism comprises:

an isolation piston; and an isolation pressure dependent barrier device in hydraulic alignment with the isolation piston and exposed to the annulus, wherein the isolation pressure dependent barrier device is a rupture disc with a burst rating substantially above a known pressure of the annulus and the isolation piston is shifted to a location blocking the channel to disrupt the hydraulic lock in response to an introduction of pressure into the annulus above the burst rating.

9. The downhole setting tool of claim 8 wherein the isolation piston is retained at a location adjacent the channel to maintain the hydraulic lock on the setting piston.

10. The downhole setting tool of claim 8 wherein the isolation piston is a first isolation piston and the pressure dependent barrier device is a first pressure dependent barrier device, the tool further comprising:

a second isolation piston; and a second pressure dependent barrier device in hydraulic alignment with the second isolation piston and exposed to the annulus, the second pressure dependent barrier device comprising a rupture disc with about the burst rating of the first pressure dependent barrier device.

11. The downhole setting tool of claim 10 wherein at least one of the first and second pressure dependent barrier devices is configured to breach upon the introduction of the pressure into the annulus above the burst rating to shift at least one of the isolation pistons to a location blocking the channel to disrupt the hydraulic lock.

12. A method of setting a downhole device in a well for an application therein, the method comprising:

deploying the device into the well with a setting tool coupled thereto;

using the setting tool to maintain a pressure balance between a setting piston coupled to the device and an annular space of the well during the deploying of the device into the well, the pressure balance to lock the setting piston;

unlocking the setting piston by disrupting the pressure balance; and breaching a volumetric chamber of the setting tool to stroke the piston for the setting of the downhole device, wherein the using of the setting tool to maintain the pressure balance comprises retaining an isolation piston at a location adjacent a locking channel that hydraulically couples the setting piston and the annular space.

13. The method of claim 12 wherein the unlocking of the setting piston comprises:

increasing the pressure in the annulus by a predetermined amount sufficient to break an isolation rupture disc adjacent the isolation piston; and shifting the isolation piston into a position blocking the locking channel to eliminate the hydraulic coupling of the setting piston to the annular space.

14. The method of claim 13 wherein the breaching of the volumetric chamber comprises further increasing the pressure in the annulus by an amount over the predetermined amount and sufficient to break a volumetric rupture disc defining the volumetric chamber.

15. The method of claim 14 further comprising distributing pressure from a setting chamber defined by the setting piston to the volumetric chamber to effect the stroking of the setting piston.

16. The method of claim 15 wherein the downhole device is a packer set in the well by the stroking of the setting piston, the method further comprising producing a downhole fluid from a location in the well downhole of the set packer.

* * * * *